US008819871B2

(12) United States Patent
Maddux et al.

(10) Patent No.: US 8,819,871 B2
(45) Date of Patent: Sep. 2, 2014

(54) HELMET WITH PARTIAL TURN FACEGUARD MOUNTING

(75) Inventors: Larry E. Maddux, Salem, IL (US); Raymond J. Drake, Jr., Salem, IL (US); Louis Anthony VanHoutin, Luka, IL (US); Vincent R. Long, St. Peters, MO (US); Cortney Warmouth, Edwardsville, IL (US)

(73) Assignee: Kranos IP Corporation, Litchfield, IL (US)

( * ) Notice: Subject to any disclaimer, the term of this patent is extended or adjusted under 35 U.S.C. 154(b) by 1031 days.

(21) Appl. No.: 12/716,769

(22) Filed: Mar. 3, 2010

(65) Prior Publication Data

US 2011/0214224 A1 Sep. 8, 2011

(51) Int. Cl.
*A42B 1/08* (2006.01)
*A42B 3/20* (2006.01)

(52) U.S. Cl.
CPC ..... *A42B 3/20* (2013.01)
USPC ..... 2/424; 2/425; 24/458

(58) Field of Classification Search
USPC ..... 2/410, 422, 424, 425, 9; D29/108, 111
See application file for complete search history.

(56) References Cited

U.S. PATENT DOCUMENTS 2,373,083 A 4/1945 Brewster
2,515,807 A 7/1950 Spooner
2,779,228 A 1/1957 Meepos et al.
3,050,736 A * 8/1962 Malcom, Jr. ..... 2/9
3,086,213 A 4/1963 Crozet et al.
3,117,484 A 1/1964 Myers
3,263,236 A * 8/1966 Humphrey ..... 2/9
3,274,613 A * 9/1966 Sowle ..... 2/9
3,283,336 A 11/1966 Critser
3,657,956 A * 4/1972 Bradley et al. ..... 411/43
3,729,746 A * 5/1973 Humphrey ..... 2/9
3,849,801 A 11/1974 Holt et al.
3,889,296 A 6/1975 Martin
4,060,855 A 12/1977 Rappleyea
4,086,664 A * 5/1978 Humphrey et al. ..... 2/9
4,130,929 A * 12/1978 Dzus ..... 29/456
4,136,403 A 1/1979 Walther et al.
4,220,301 A * 9/1980 Jacobs et al. ..... 248/74.3
4,250,600 A * 2/1981 Gunther ..... 411/500
4,287,613 A 9/1981 Schulz
4,363,140 A * 12/1982 Correale ..... 2/9
4,370,759 A 2/1983 Zide
4,390,995 A * 7/1983 Walck ..... 2/9
4,566,137 A 1/1986 Gooding (Continued)

*Primary Examiner* — Khoa Huynh
*Assistant Examiner* — Brieanna Szafran
(74) *Attorney, Agent, or Firm* — Notaro, Michalos & Zaccaria P.C.

(57) ABSTRACT

A helmet has a shell with a front opening covered by a faceguard of elongated wire segments. Loopstraps engage around wire segments at sides and a crown of the shell and fasteners connect the loopstraps to the shell. The fasteners each have a nut extending from an inside of the helmet shell out into a hole of the shell and an aperture of the loopstrap, and a stud removably connected to the nut by pushing and turning the stud by about a quarter turn to lock the stud to the nut. A tension spring between a head of the stud and the loopstrap urges the stud away from the nut when the stud is rotated to unlock the stud for facilitating a quick removal of the stud from the nut and a quick disconnection of the loopstrap and faceguard from the helmet shell.

16 Claims, 4 Drawing Sheets

(56) References Cited

U.S. PATENT DOCUMENTS

| | | | | | |
|---|---|---|---|---|---|
| 4,587,677 | A | * | 5/1986 | Clement | 2/424 |
| 4,633,531 | A | | 1/1987 | Nimmons et al. | |
| 4,653,970 | A | * | 3/1987 | Ballantyne | 411/555 |
| 4,718,127 | A | | 1/1988 | Rittmann et al. | |
| 4,837,866 | A | * | 6/1989 | Rector et al. | 2/424 |
| 4,885,807 | A | | 12/1989 | Snow, Jr. | |
| 4,887,320 | A | | 12/1989 | Long et al. | |
| 4,901,987 | A | * | 2/1990 | Greenhill et al. | 267/166 |
| 4,985,938 | A | * | 1/1991 | Snow, Jr. | 2/424 |
| 5,014,365 | A | | 5/1991 | Schulz | |
| 5,061,112 | A | | 10/1991 | Monford | |
| 5,095,552 | A | * | 3/1992 | Parkinson | 2/424 |
| 5,242,430 | A | * | 9/1993 | Arenas et al. | 16/110.1 |
| 5,263,203 | A | | 11/1993 | Kraemer et al. | |
| 5,293,649 | A | | 3/1994 | Corpus | |
| 5,452,979 | A | | 9/1995 | Cosenza | |
| 5,479,658 | A | | 1/1996 | Harris | |
| 5,502,843 | A | | 4/1996 | Strickland | |
| 5,555,567 | A | | 9/1996 | Corpus | |
| 5,639,074 | A | * | 6/1997 | Greenhill et al. | 267/162 |
| 5,674,034 | A | * | 10/1997 | Bennett | 411/197 |
| 5,675,875 | A | | 10/1997 | Servatius | |
| 5,978,973 | A | * | 11/1999 | Chartrand | 2/422 |
| 6,068,250 | A | * | 5/2000 | Hawkins et al. | 267/162 |
| 6,079,053 | A | * | 6/2000 | Clover et al. | 2/424 |
| 6,199,219 | B1 | | 3/2001 | Silken et al. | |
| 6,234,837 | B1 | * | 5/2001 | Wu | 439/564 |
| 6,292,953 | B1 | | 9/2001 | Beautz | |
| 6,301,719 | B1 | | 10/2001 | Goodhand et al. | |
| 6,301,720 | B1 | | 10/2001 | Bataille et al. | |
| 6,487,786 | B2 | | 12/2002 | Beautz | |
| 6,669,184 | B2 | * | 12/2003 | Cai et al. | 267/162 |
| 6,758,465 | B1 | * | 7/2004 | Greenhill et al. | 267/166 |
| 6,892,393 | B1 | | 5/2005 | Provost et al. | |
| 6,934,971 | B2 | | 8/2005 | Ide et al. | |
| 7,036,151 | B2 | * | 5/2006 | Ide et al. | 2/9 |
| 7,146,652 | B2 | * | 12/2006 | Ide et al. | 2/422 |
| 7,328,462 | B1 | | 2/2008 | Straus | |
| 2004/0025231 | A1 | * | 2/2004 | Ide et al. | 2/425 |
| 2005/0278835 | A1 | | 12/2005 | Ide et al. | |
| 2006/0037125 | A1 | | 2/2006 | McDowell | |
| 2007/0151003 | A1 | | 7/2007 | Shih | |
| 2007/0192944 | A1 | * | 8/2007 | Ide et al. | 2/410 |
| 2007/0245468 | A1 | | 10/2007 | Butler | |
| 2008/0250550 | A1 | | 10/2008 | Bologna et al. | |
| 2008/0310931 | A1 | * | 12/2008 | Csik et al. | 411/103 |
| 2010/0251464 | A1 | * | 10/2010 | Parisi | 2/424 |

* cited by examiner

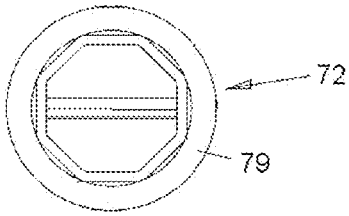
FIG. 3C
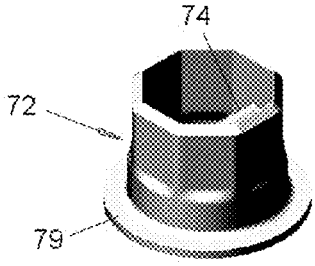
FIG. 3
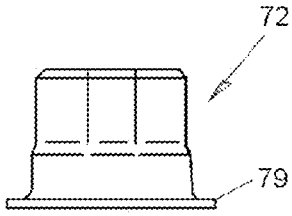
FIG. 3B
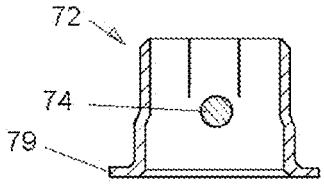
FIG. 3A
FIG. 4B
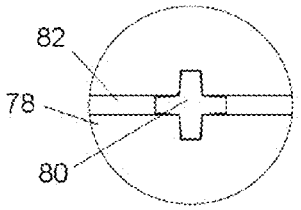
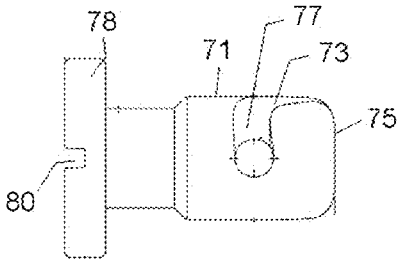
FIG. 4C
FIG. 4D
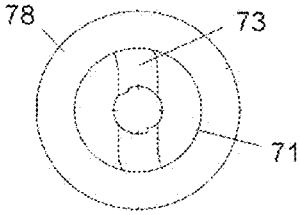
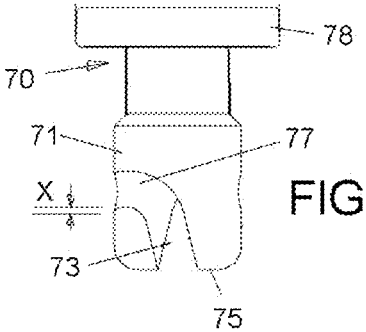
FIG. 4A
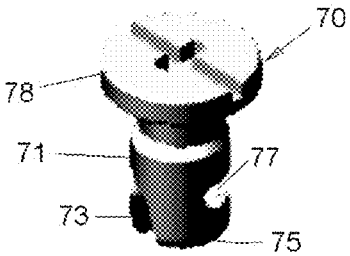
FIG. 4

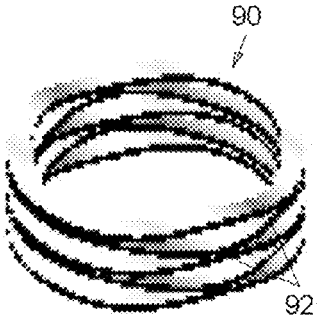
FIG. 5
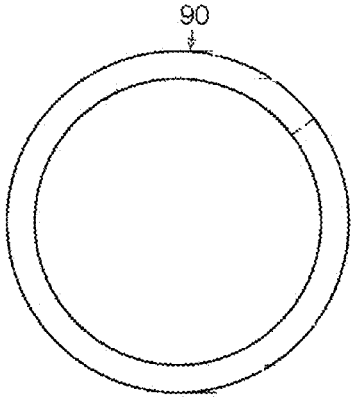
FIG. 5A
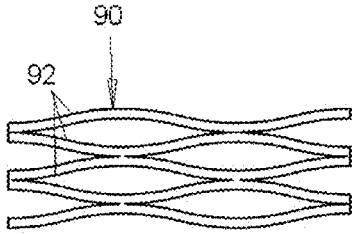
FIG. 5B
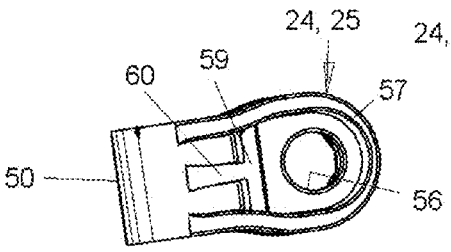
FIG. 6B
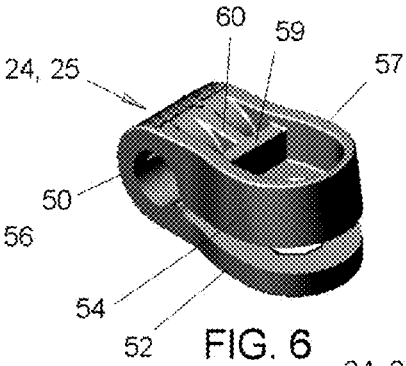
FIG. 6
FIG. 6C
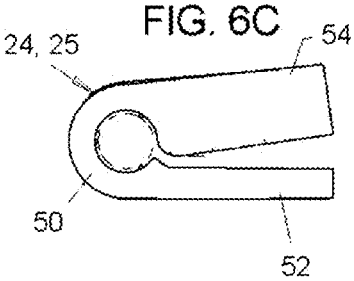
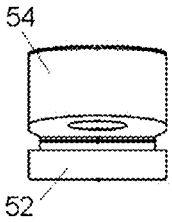
FIG. 6D
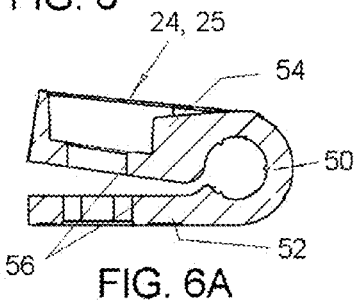
FIG. 6A

HELMET WITH PARTIAL TURN FACEGUARD MOUNTING

FIELD AND BACKGROUND OF THE INVENTION

The present invention relates generally to the field of sports headgear and, in particular, to a new and useful mechanism for quickly attaching and removing the faceguard of a helmet with a quick connection that is based on the use of a partial turn fastener.

People engaged in contact sports or other potentially dangerous activities, are occasionally injured. Football helmets and other types of helmets are meant to reduce such injures, especially to the head and face. For this reason they often include a face opening covered by a protective faceguard that is secured to the helmet. When a player or dangerous activity participant is injured, a medical professional must assess and sometimes also treat the injury at the very place the injury occurred. When trainers and doctors are examining a player who has been injured, they often will need to ask the injured person questions. They also may need to look into the player's eyes and generally examine the persons head and face. Additionally, sometimes the injured person will need to drink water or in extreme cases will need oxygen to be administered. Therefore, a trainer or physician's view of and access to the injured persons face must be unobstructed. Accordingly in such situations, the person's faceguard must be removed. Since the injury may involve the neck, it is also important that the faceguard be removed with minimal movement to the player's head and neck.

It is known to use plastic loopstraps that engage around the side and top elongated wire segments of a faceguard, and that are fastened to a football helmet shell by threaded T-nuts and screw-type fasteners to hold the faceguard to the helmet. Understanding the need for rapid removal of the faceguard in case an athlete wearing the helmet is injured, it is also known to simply cut the loopstraps using, for example, wire cutters, to quickly remove the faceguard with as little movement of the athlete's head as possible. See, for example, U.S. Pat. No. 4,633,531 assigned to the owner of the subject application, that teaches the use of such plastic loopstraps and threaded fasteners. Also see U.S. Pat. Nos. 5,293,649 and 5,555,567 to Corpus and U.S. Pat. No. 5,479,658 to Harris for other examples of the use of loopstraps to connect a faceguard to a helmet shell.

Published U.S. Patent Application US 2007/0245468 to Butler discloses a protective helmet with an internal suspension system including a support of webbing structure configured to fit to the curved shape of a wearer's head. Size-adjustment ends of the support extend out through apertures in back of the helmet shell so that the wearer can assess the ends to make size adjustments. To avoid snagging, the apertures and support ends are covered by a cover, and the cover can be attached to the helmet shell by quarter-turn or half-turn screw fasteners so the person wearing the helmet or an assistant can quickly remove and replace the cover. See paragraph [0040] of Butler. Butler, while also suggesting the use of loopstraps to connect a faceguard to a helmet in FIG. 1 of the reference, for example, does not suggested the usefulness of quick connectors for also connecting the loopstraps to the helmet, or any reason for doing this.

U.S. Pat. No. 6,292,953 to Beaitz discloses quarter-turn fasteners to hold an inner fitted helmet inside an outer helmet shell. No details about the quarter-turn fastener are taught, however.

U.S. Pat. No. 4,718,127 to Rittmann et al. discloses a transparent face shield or visor that can be tilted up and held in an open detent position with respect to the shell of a motorcycle helmet by rotary hinges that each include a washer spring loaded shank with a cam member that can be turned by rotation of the shank and held by the biasing force of the spring in the open position.

See the following U.S. patents and published patent application for other examples of quarter-turn fasteners used to attach parts to a helmet, but never with the structure or purpose of attaching the elongated wire segments of a faceguard to a helmet shell, nor the realization that rapid removal of the faceguard is a goal: U.S. Pat. No. 3,086,213 to Crozat et al. at col. 2, lines 38-44; U.S. Pat. No. 4,887,320 to Long et al. at col. 5, lines 20-31; U.S. Pat. No. 6,301,720 to Bataille et al. at col. 3 and 4, lines 60-65; U.S. Pat. No. 6,892,393 to Provost et al. at col. 4, lines 58-61; and Published Patent Application US 2006/0037125 to McDowell at paragraphs [0028] and [0033].

There remains a need for new and useful ways to attach and remove the faceguard of a player's or participant's protective helmet, with little or no movement of the persons head and neck.

SUMMARY OF THE INVENTION

It is an object of the present invention to provide a helmet that has a shell with sides and a crown defining a front opening for a faceguard made of elongated wire segments, with loopstraps engaging around wire segments of the faceguard at the sides and crown, and partial turn fasteners connecting the loopstraps to the helmet shell. The fasteners for the sides at least, but preferably also for the crown, are each made of a nut extending from an inside of the helmet shell out into a hole of the shell and an aperture of the loopstrap, and a stud removably connected to the nut by pushing and turning the stud by a partial and preferably by about a quarter turn, to lock the stud to the nut and connect the loopstrap of the helmet shell. A tension spring between a head of the stud and the loopstrap urges the stud away from the nut when the stud is rotated to unlock the stud for facilitating a quick removal of the stud from the nut and therefore a quick disconnection of the loopstrap and faceguard from the helmet shell.

Another object of the invention is to provide a helmet with a quick faceguard connection and removal feature that is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 3 is a perspective view of a nut of the mounting;

FIG. 3A is a sectional view of the nut;

FIG. 3B is a side view of the nut;

FIG. 3C is a bottom view of the nut;

FIG. 4 is a perspective view of a stud of the mounting;

FIG. 4A is a side view of the stud;

FIG. 4B is a top view of the stud;

FIG. 4C is a side view of the stud taken at 90 degrees to the view of FIG. 4A;

FIG. 4D is a bottom view of the stud;

FIG. 5 is a perspective view of a spring of the mounting;

FIG. 5A is a top view of the spring;

FIG. 5B is a side view of the spring;

FIG. 6 is a perspective view of a loopstrap of the mounting;

FIG. 6A is a side sectional view of the loopstrap;

FIG. 6B is a top view of the loopstrap;

FIG. 6C is a side view of the loopstrap;

FIG. 6D is an end view of the loopstrap;

DESCRIPTION OF THE PREFERRED EMBODIMENTS

Figure 1:
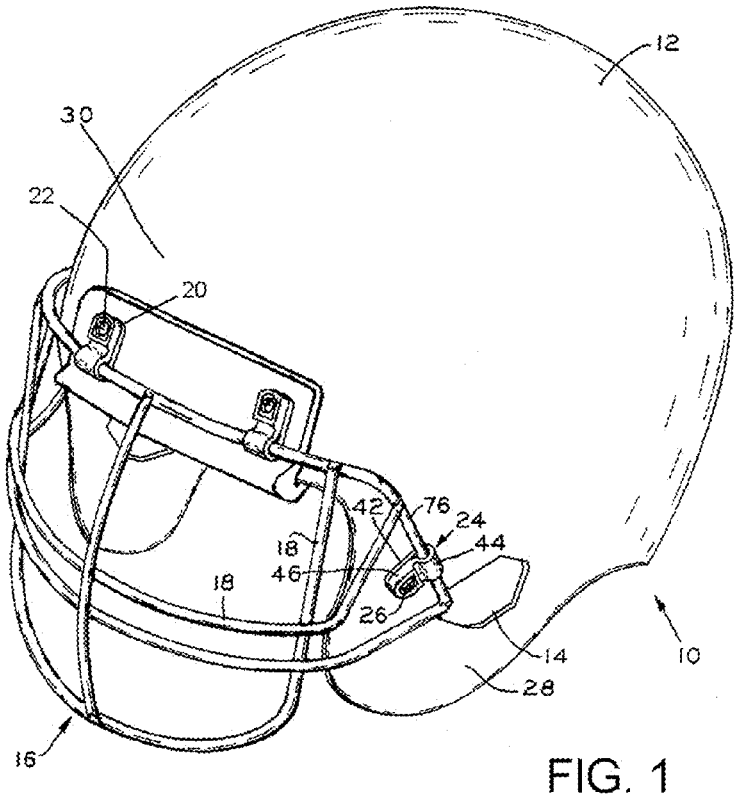
FIG. 1 is a perspective view of the helmet of the present invention with its faceguard and partial turn mounting.
Figure 7:
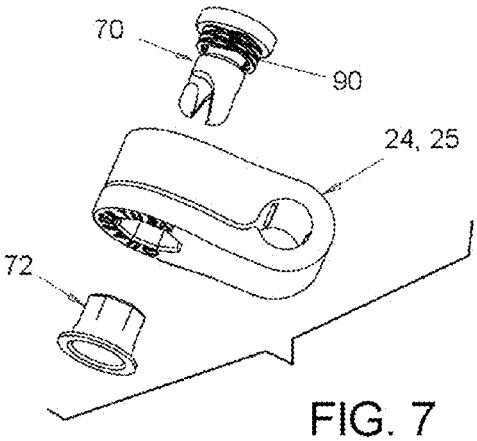
FIG. 7 is another exploded perspective view of the loopstrap and stud with nut forming a partial turn fastener of the invention.
Figure 8:
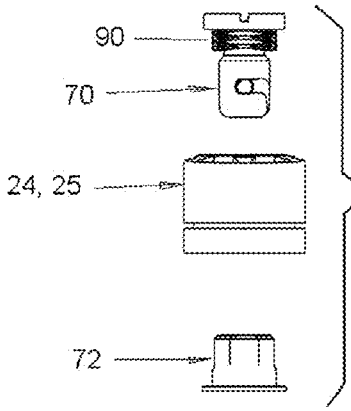
FIG. 8 is an exploded end view of the loopstrap and fastener.
Figure 2:
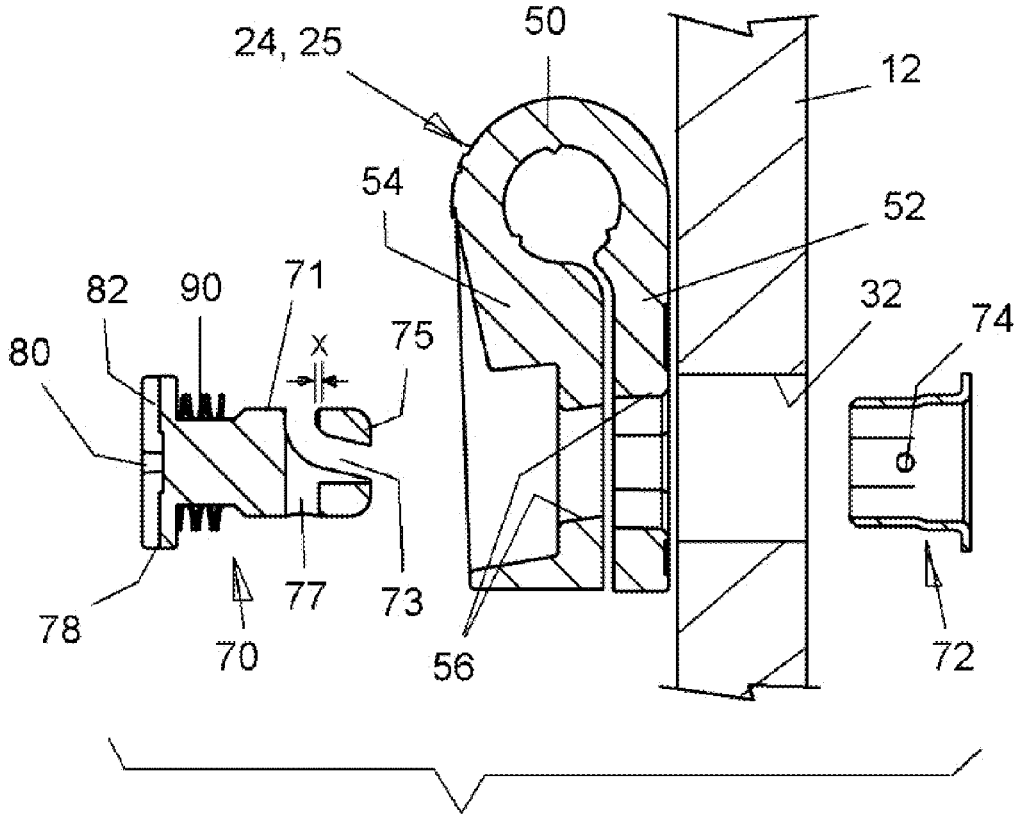
FIG. 2 is an exploded sectional view of the partial turn mounting before it is connected to the shell of the helmet.

Referring now to the drawings, in which like reference numerals are used to refer to the same or similar elements, FIGS. 1, 2, 7 and 8 illustrate a protective helmet of the invention, comprising a helmet shell 12 having opposite sides 28 and a crown 30 with front edges defining a front opening for exposing the face of a wearer of the helmet, the opposite sides 28 and the crown 30 each containing a hole, one shown at 32 in FIG. 2, through the helmet shell and adjacent the front opening.

A faceguard 16 comprising a plurality of elongated wire segments 18 that are connected to each other, extends across the opposite sides 28 and downwardly from the crown 30 of the helmet shell 12 for covering at least a portion of the front opening to protect the wearers face. A first loopstrap 24 is engaged around one of the wire segments 76 of the faceguard that has at least a portion that is adjacent one side 28 of the helmet shell 12 on one side of the front opening. A second loopstrap 25 engages around the same or a different wire segment of the faceguard 16 that is adjacent the opposite side of the helmet shell to the left in FIG. 1, on an opposite side of the front opening. One, or preferably two spaced apart third loopstraps 20 engage around the same or a different one wire segment of the faceguard 16 that has at least a portion that is adjacent the crown 30 of the helmet shell 12 at the top of the front opening.

As also shown in FIGS. 6, 6A, 6B, 6C and 6D, each of the loopstraps 20, 24 and 25 has a curved loop 50 for receiving the wire segment of the faceguard to hold the loopstrap to the faceguard, and first 52 and second 54 elongated straps extending parallel to each other and from the loop 50. The straps 52 and 54 each contain an aperture 56 spaced from the loop 50 and the wire segment that is received in the loop. The apertures 56 are aligned with each other with the first strap 52 lying adjacent the helmet shell 12 and the second strap 54 being spaced from the helmet shell. Each of the aligned apertures 56 of one loopstrap are laid over and aligned with one of the holes 32 of the sides or crown of the helmet shell 12 as best shown in FIG. 2.

According to the invention, a fastener extends through each set of the aligned apertures 56 and helmet shell holes 32 for connecting the faceguard 16 to the helmet shell.

While only the loopstraps 24 and 25 at the sides 28 of the helmet can be connected with the new partial turn fasteners of the invention, with conventional threaded nut and screw fasteners being used for the crown loopstraps 20, it is preferred and advantageous for all the loopstraps to be connected using the fasteners of the invention so that in case the faceguard of an injured wearer of the helmet must be removed entirely, it can be quickly removed using a Philips head or blade screw driver, or even a small coin. In case there is actually no injury, the faceguard can be re-connected to the helmet just as quickly to the allow the wearer to continue play. This was not possible in the prior art case where the loopstraps were cut to gain free access to the players face. If it turned out that the player was not injured, he would need a new helmet to resume play.

The partial turn fasteners of the invention that extend through the loopstrap apertures and helmet shell hole of the opposite sides of the helmet shell at least, and preferably through the apertures and aligned helmet shell holes at all locations, comprises a nut 72 extending from an inside of the helmet shell 12 out into the hole 32 and into at least the aperture 56 of the first strap 52 of each loopstrap. A stud 70 is removably connected to the nut 72 and extends from an outside of the helmet shell 12, into the aperture 56 of the second strap 54 and into the nut 72. The fastener also includes partial turn means between the nut 72 and the stud 70 for locking the stud to the nut when the stud is rotated by less than one half a revolution of the stud about its axis, and preferably by a quarter turn of the stud.

The preferred embodiment of the partial turn means is disclosed later in this application, however, other partial turn mechanisms can be used between the stud and the nut, such partial turn means being defined here as requiring less than one half of one full turn around the axis of the stud to make the desired connection with the nut.

As best shown in FIGS. 3, 3A, 3B and 3C, at least a portion of the outer surface of nut 72 is non-circular so that it is closely engaged to an inner surface of the aperture 56 of the first strap 52 that is also correspondingly non-circular (see FIG. 7 for example), so that the nut 72 will not rotate in the aperture of the first strap 52 when the stud 70 is rotated. This permits the stud 70 to rotate with respect to the nut 72 without having to engage the nut with any special tool. The non-circular portion of the nut and the non-circular aperture of the first strap are octagonal in the preferred embodiment, but may be any polygon or even oval or star shaped to fix the nut rotationally in the aperture 56 of the first strap 52, and prevent co-rotation of the nut 72 and stud 70.

A tension spring 90 best shown in FIGS. 5, 5A and 5B, is provided between the stud 70 and the nut 72, in particular between the stud 70 and its associated loopstrap, for urging the stud away from the nut when the stud is rotated in an opposite direction to unlock the stud from the nut for facilitating a quick removal of the stud from the nut and thus a quick disconnection of the loopstrap from the helmet shell.

As best shown in FIGS. 4, 4A, 4B, 4C and 4D, the stud 70 comprises an axial shaft 71 and, as shown FIGS. 3 and 3A, 3B and 3C, the nut 72 comprises a barrel having an interior for receiving the shaft of the stud. The partial turn means comprises a locking pin 74 extending across the nut interior in the nut barrel, with the stud having a helically twisting and radially extending channel 73 that opens at a free end 75 of the shaft 71, for receiving the locking pin 74 as the stud is inserted into the nut barrel interior, the channel twisting in a partial, preferably quarter or 90 degree turn inside the shaft 71 and in a first axial direction away from the free end 75 and toward a head 78 of the stud. The channel 73 ends inside the shaft 71 at a blind base of the channel at 77 where the channel forms a seat for the locking pin 74 by having the channel extend in a second opposite axial direction away from the stud head 78 by a small axial distance X see FIGS. 2 and 4A. In this way the pin 74 is caught in the seat at channel end 77, the tension spring 90 urging the locking pin to remain in the blind base or end 77 of the channel 73. The stud can be rotated in an opposite direction to unseat the pin 74 against the bias of spring 90 but a positive rotational force is needed to overcome the spring's biasing force. This avoids accidental disconnection of the stud for the nut and corresponding accidental disconnection of the faceguard from the helmet shell.

Returning to FIGS. 6 and 6B, the second strap 54 of each loopstrap includes a U-shaped peripheral wall 57 around the aperture 56 for stiffening the second strap and for surrounding the head 78 of the stud 70, the tension spring 90 engaging around the stud shaft near the head for engaging the second strap around the aperture and inside the peripheral wall 57. The second strap also includes a stiffening partition 59 extending across the second strap near the loop 50 of the second strap and between legs of the U-shaped peripheral wall 57, the peripheral wall extending onto the loop 50. A buttress 60 also extends perpendicularly from the stiffening partition 59 and parallel to and between the legs of the peripheral wall 57 onto the loop 50 for further stiffening the second strap.

Referring to FIGS. 5, 5A and 5B once more, the tension spring 90 comprises a stack of wave spring metal rings 92 having crests that are connected to each other, e.g. by soldering, the stack of rings engaging around the stud shaft 71 near the stud head 78.

While a specific embodiment of the invention has been shown and described in detail to illustrate the application of the principles of the invention, it will be understood that the invention may be embodied otherwise without departing from such principles.

What is claimed is:

1. A protective helmet, comprising: a helmet shell (12) having opposite sides (28) and a crown (30) with front edges defining a front opening for exposing the face of a wearer of the helmet, the opposite sides and the crown each containing a hole (32) through the helmet shell and adjacent the front opening;

a faceguard (16) comprising a plurality of elongated wire segments (18) that are connected to each other, the faceguard extending across the opposite sides and downwardly from the crown of the helmet shell for covering at least a portion of the front opening;

a first loopstrap (24) engaged around one wire segment (76) of the faceguard that has at least a portion that is adjacent one side (28) of the helmet shell (12) on one side of the front opening;

a second loopstrap (25) engaged around one wire segment of the faceguard that is adjacent an opposite side of the helmet shell on an opposite side of the front opening;

a third loopstrap (20) engaged around one wire segment (76) of the faceguard that has at least a portion that is adjacent the crown (30) of the helmet shell at a top of the front opening;

each loopstrap having a curved loop (50) for receiving the wire segment to hold the loopstrap to the faceguard, and first (52) and second (54) elongated straps extending parallel to each other and from the loop (50), the straps (52, 54) each containing an aperture (56) spaced from the wire segment that is received in the loop, the apertures being aligned with each other, the first strap (52) lying adjacent the helmet shell (12) and the second strap (54) being spaced from the helmet shell, each of the aligned apertures of one loopstrap being over and aligned with one of the holes (32) of the sides or crown of the helmet shell; and a fastener extending through each set of the aligned apertures and helmet shell hole for connecting the faceguard to the helmet shell;

at least the fasteners extending through the loopstrap apertures and helmet shell hole of the opposite sides of the helmet shell comprising:

a nut (72) extending from an inside of the helmet shell out into the hole and into at least the aperture of the first strap (52);

a stud (70) removably connected to the nut and extending from an outside of the helmet shell, into the aperture of the second strap (54) and into the nut (72);

partial turn means between the nut and the stud for locking the stud to the nut when the stud is rotated by less than one half a revolution of the stud about its axis;

at least a portion of an outer surface of the nut being non-circular and being closely engaged to an inner surface of the aperture of the first strap which is also non-circular so that the nut will not rotate in the aperture of the first strap when the stud is rotated;

wherein the stud comprises an axial shaft (71) and the nut comprises a barrel having an interior for receiving the shaft of the stud, the partial turn means comprising a locking pin (74) extending across the nut interior and the stud having a helically twisting and radially extending channel (73) that opens at a free end (75) of the shaft for receiving the locking pin and twists in a partial turn in the shaft in a first axial direction away from the free end of the shaft to a blind base (77) of the channel where the channel forms a seat for the locking pin (74) that extends in a second opposite axial direction, the tension spring urging the locking pin to remain in the blind base of the channel, the stud having an enlarged head (78) connected to the shaft for engaging the second strap to fix a position of the stud in the aligned apertures of the loopstrap, and the nut having a head (79) connected to the barrel for engaging the helmet shell around the hole to fix a position of the nut in the helmet shell hole, the stud head (78) having an outer surface opposite of the free end with at least one screw-driver engaging opening (80, 82) therein; and a tension spring (90) between the stud and the nut for urging the stud away from the nut when the stud is rotated to unlock the stud from the nut for facilitating a quick removal of the stud from the nut and a quick disconnection of the loopstrap and faceguard from the helmet shell; and wherein the tension spring comprises a stack of wave rings (92) having crests that are connected to each other.

2. The protective helmet of claim 1, wherein the partial turn means is a quarter turn means.

3. The protective helmet of claim 1, wherein the fasteners of all of the first, second and third loopstraps are of the same type.

4. The protective helmet of claim 1, wherein the fasteners of all of the loopstraps are of the same type, there being two third loopstraps for connecting the faceguard to the helmet shell at two spaced locations on the helmet crown.

5. The protective helmet of claim 1, wherein the non-circular portion of the nut and the non-circular aperture of the first strap are octagonal.

6. The protective helmet of claim 1, wherein the stud has a shaft extending into the nut and an enlarged head (78) connected to the shaft for engaging the second strap to fix a position of the stud in the aligned apertures of the loopstrap, the wave rings of the tension spring being engages engaged around the stud shaft near the stud head and against the second strap around the aperture in the second strap.

7. The protective helmet of claim 1, wherein the stud has a shaft extending into the nut and an enlarged head (78) connected to the shaft for engaging the second strap to fix a position of the stud in the aligned apertures of the loopstrap, the wave rings of the tension spring being engages engaged around the stud shaft near the stud head, the non-circular portion of the nut and the non-circular aperture of the first strap being octagonal.

8. The protective helmet of claim 1, wherein the stud comprises a shaft for extending into the nut and a head connected to the shaft, the second strap (54) of each loopstrap including a peripheral wall (57) around the aperture (56) for stiffening the second strap and for surrounding the head of the stud, the tension spring comprising the stack of connected wave rings engaged around the stud shaft near the head for engaging the second strap around the aperture and inside the peripheral wall.

9. The protective helmet of claim 1, wherein the stud comprises a shaft for extending into the nut and a head (78) connected to the shaft, the second strap (54) of each loopstrap including a U-shaped peripheral wall (57) around the aperture (56) for stiffening the second strap and for surrounding the head of the stud, the tension spring comprising the stack of connected wave rings engaged around the stud shaft near the head for engaging the second strap around the aperture and inside the peripheral wall, the second strap also including a stiffening partition (59) extending across the second strap near the loop (50) of the second strap and between legs of the U-shaped peripheral wall (57), the peripheral wall extending onto the loop, and a buttress (60) extending perpendicularly of the stiffening partition and parallel to and between the legs of the peripheral wall onto the loop for further stiffening the second strap, the stud head (78) having an outer surface opposite on the free end with at least one screw-driver engaging opening (80, 82) therein.

10. The protective helmet of claim 1, wherein the stud comprises an axial shaft (71) and the nut comprises a barrel having an interior for receiving the shaft of the stud, the partial turn means comprising a locking pin (74) extending across the nut interior and the stud having a helically twisting and radially extending channel (73) that opens at a free end (75) of the shaft for receiving the locking pin and twists in a partial turn in the shaft in a first axial direction away from the free end of the shaft to a blind base (77) of the channel where the channel forms a seat for the locking pin (74) that extends in a second opposite axial direction, the channel twisting by about 90 degrees so that a quarter turn locks the stud to the nut, the tension spring urging the locking pin to remain in the blind base of the channel, the stud having an enlarged head (78) connected to the shaft for engaging the second strap to fix a position of the stud in the aligned apertures of the loopstrap, and the nut having a head (79) connected to the barrel for engaging the helmet shell to fix a position of the nut in the helmet shell hole, the wave rings of the tension spring being engaged around the stud shaft near the stud head and the non-circular portion of the nut and the non-circular aperture of the first strap being octagonal, the second strap (54) of each loopstrap including a U-shaped peripheral wall (57) around the aperture (56) for stiffening the secondstrap and for surrounding the head of the stud, the tension spring comprising the stack of connected wave rings engaged around the stud shaft near the head for engaging the second strap around the aperture and inside the peripheral wall, the second strap also including a stiffening partition (59) extending across the second strap near the loop (50) of the second strap and between legs of the U-shaped peripheral wall (57), the peripheral wall extending onto the loop, and a buttress (60) extending perpendicularly of the stiffening partition and parallel to and between the legs of the peripheral wall onto the loop for further stiffening the second strap, the stud head (78) having an outer surface opposite of the free end with at least one screw-driver engaging opening (80, 82) therein.

11. A protective helmet, comprising:

a helmet shell (12) having opposite sides (28) and a crown (30) with front edges defining a front opening for exposing the face of a wearer of the helmet, the opposite sides and the crown each containing a hole (32) through the helmet shell and adjacent the front opening;

a faceguard (16) comprising a plurality of elongated wire segments (18) that are connected to each other, the faceguard extending across the opposite sides and downwardly from the crown of the helmet shell for covering at least a portion of the front opening;

a first loopstrap (24) engaged around one wire segment (76) of the faceguard that has at least a portion that is adjacent one side (28) of the helmet shell (12) on one side of the front opening;

a second loopstrap (25) engaged around one wire segment of the faceguard that is adjacent an opposite side of the helmet shell on an opposite side of the front opening;

a third loopstrap (20) engaged around one wire segment (76) of the faceguard that has at least a portion that is adjacent the crown (30) of the helmet shell at a top of the front opening; each loopstrap having a curved loop (50) for receiving the wire segment to hold the loopstrap to the faceguard, and first (52) and second (54) elongated straps extending parallel to each other and from the loop (50), the straps (52, 54) each containing an aperture (56) spaced from the wire segment that is received in the loop, the apertures being aligned with each other, the first strap (52) lying adjacent the helmet shell (12) and the second strap (54) being spaced from the helmet shell, each of the aligned apertures of one loopstrap being over and aligned with one of the holes (32) of the sides or crown of the helmet shell; and a fastener extending through each set of the aligned apertures and helmet shell holes for connecting the faceguard to the helmet shell;

at least the fasteners extending through the loopstrap apertures and helmet shell hole of the opposite sides of the helmet shell comprising:

a nut (72) extending from an inside of the helmet shell out into the hole and into at least the aperture of the first strap (52);

a stud (70) removably connected to the nut and extending from an outside of the helmet shell, into the aperture of the second strap (54) and into the nut (72);

partial turn means between the nut and the stud for locking the stud to the nut when the stud is rotated by less than one half a revolution of the stud about its axis;

at least a portion of an outer surface of the nut being non-circular and being closely engaged to an inner surface of the aperture of the first strap which is also non-circular so that the nut will not rotate in the aperture of the first strap when the stud is rotated; and a tension spring (90) between the stud and the nut for urging the stud away from the nut when the stud is rotated to unlock the stud from the nut for facilitating a quick removal of the stud from the nut and a quick disconnection of the loopstrap from the helmet shell; the partial turn means being a quarter turn means and the fasteners of all of the loopstraps being of the same type;

each stud comprising an axial shaft (71) and the nut comprising a barrel having an interior for receiving the shaft of the stud; the quarter turn means comprising a locking pin (74) extending across the nut interior and the stud having a 90 degree helically twisting and radially extending channel (73) that opens at a free end (75) of the shaft for receiving the locking pin and twists in a partial turn in the shaft in a first axial direction away from the free end of the shaft to a blind base (77) of the channel where the channel forms a seat for the locking pin (74) that extends in a second opposite axial direction, the tension spring urging the locking pin to remain in the blind base of the channel, the stud having a shaft extending into the nut and an enlarged head (78) connected to the shaft for engaging the second strap to fix a position of the stud in the aligned apertures of the loopstrap, and the nut having a head (79) connected to the barrel for engaging the helmet shell to fix a position of the nut in the helmet shell hole, the stud head (78) having an outer surface opposite of the free end with at least one screw-driver engaging opening (80, 82) therein; and wherein the tension spring comprises a stack of wave rings having crests that are connected to each other.

12. The protective helmet of claim 11, wherein the stud has a shaft extending into the nut and an enlarged head (78) connected to the shaft for engaging the second strap to fix a position of the stud in the aligned apertures of the loopstrap, the wave rings of the tension spring being engages engaged around the stud shaft near the stud head.

13. The protective helmet of claim 11, wherein the stud has a shaft extending into the nut and an enlarged head (78) connected to the shaft for engaging the second strap to fix a position of the stud in the aligned apertures of the loopstrap, the rings of the tension spring being engaged around the stud shaft near the stud head, the non-circular portion of the nut and the non-circular aperture of the first strap being octagonal.

14. The protective helmet of claim 11, wherein the stud comprises a shaft for extending into the nut and a head connected to the shaft, the second strap (54) of each loopstrap including a peripheral wall (57) around the aperture (56) for stiffening the second strap and for surrounding the head of the stud, the tension spring comprising the stack of connected wave rings engaged around the stud shaft near the head for engaging the second strap around the aperture and inside the peripheral wall.

15. The protective helmet of claim 11, wherein the stud comprises a shaft for extending into the nut and a head (78) connected to the shaft, the second strap (54) of each loopstrap including a U-shaped peripheral wall (57) around the aperture (56) for stiffening the second strap and for surrounding the head of the stud, the tension spring comprising the stack of connected wave rings engages engaged around the stud shaft near the head for engaging the second strap around the aperture and inside the peripheral wall, the second strap also including a stiffening partition (59) extending across the second strap near the loop (50) of the second strap and between legs of the U-shaped peripheral wall (57), the peripheral wall extending onto the loop, and a buttress (60) extending perpendicularly of the stiffening partition and parallel to and between the legs of the peripheral wall onto the loop for further stiffening the second strap, the stud head (78) having an outer surface opposite of the free end with at least one screw-driver engaging opening (80, 82) therein.

16. A protective helmet, comprising:

a helmet shell (12) having opposite sides (28) and a crown (30) with front edges defining a front opening for exposing the face of a wearer of the helmet, the opposite sides and the crown each containing a hole (32) through the helmet shell and adjacent the front opening;

a faceguard (16) comprising a plurality of elongated wire segments (18) that are connected to each other, the faceguard extending across the opposite sides and downwardly from the crown of the helmet shell for covering at least a portion of the front opening;

a first loopstrap (24) engaged around one wire segment (76) of the faceguard that has at least a portion that is adjacent one side (28) of the helmet shell (12) on one side of the front opening;

a second loopstrap (25) engaged around one wire segment of the faceguard that is adjacent an opposite side of the helmet shell on an opposite side of the front opening;

a third loopstrap (20) engaged around one wire segment (76) of the faceguard that has at least a portion that is adjacent the crown (30) of the helmet shell at a top of the front opening;

each loopstrap having a curved loop (50) for receiving the wire segment to hold the loopstrap to the faceguard, and first (52) and second (54) elongated straps extending parallel to each other and from the loop (50), the straps (52, 54) each containing an aperture (56) spaced from the wire segment that is received in the loop, the apertures being aligned with each other, the first strap (52) lying adjacent the helmet shell (12) and the second strap (54) being spaced from the helmet shell, each of the aligned apertures of one loopstrap being over and aligned with one of the holes (32) of the sides or crown of the helmet shell; and a fastener extending through each set of the aligned apertures and helmet shell hole for connecting the faceguard to the helmet shell, the fasteners each comprising:

a nut (72) extending into the hole;

a stud (70) removably connected to the nut and extending at least into the aperture of the second strap (54) and into the nut (72);

quarter turn means between the nut and the stud for locking the stud to the nut when the stud is rotated by less than one half a revolution of the stud about its axis;

wherein the stud comprises an axial shaft (71) and the nut comprises a barrel having an interior for receiving the shaft of the stud, the quarter turn means comprising a locking pin (74) extending across the nut interior and the stud having a helically twisting and radially extending channel (73) that opens at a free end (75) of the shaft for receiving the locking pin and twists in a partial turn in the shaft in a first axial direction away from the free end of the shaft to a blind base (77) of the channel where the channel forms a seat for the locking pin (74) that extends in a second opposite axial direction, the channel twisting by about 90 degrees so that a quarter turn locks the stud to the nut, at least a portion of an outer surface of the nut being non-circular and being closely engaged to an inner surface of the aperture of the first strap which is also non-circular so that the nut will not rotate in the aperture of the first strap when the stud is rotated;

a tension spring (90) between the stud and the nut for urging the stud away from the nut when the stud is rotated to unlock the stud from the nut for facilitating a quick removal of the stud from the nut and a quick disconnection of the loopstrap and faceguard from the helmet shell;

the tension spring urging the locking pin to remain in the blind base of the channel, the stud having an enlarged head (78) connected to the shaft for engaging the second strap to fix a position of the stud in the aligned apertures of the loopstrap, and the nut having a head (79) connected to the barrel for engaging the helmet shell to fix a position of the nut in the helmet shell hole;

the tension spring comprises a stack of wave rings having crests that are connected to each other, the wave rings of the tension spring being engaged around the shaft of the stud near the enlarged head of the stud and the non-circular portion of the nut and the non-circular aperture of the first strap being octagonal.

* * * * *